US011160433B2

(12) United States Patent
Horn et al.

(10) Patent No.: US 11,160,433 B2
(45) Date of Patent: Nov. 2, 2021

(54) DISHWASHING APPLIANCE HAVING A MULTI-ZONE SPRAY ASSEMBLY TO ALTERNATE THE SPRAY OF WASH FLUID

(71) Applicant: Haier US Appliance Solutions, Inc., Wilmington, DE (US)

(72) Inventors: Austin Horn, Independence, KY (US); Adam Christopher Hofmann, Louisville, KY (US); Kyle Edward Durham, Louisville, KY (US); Craig Curtis, Crestwood, KY (US); John Edward Dries, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/748,960

(22) Filed: Jan. 22, 2020

(65) Prior Publication Data

US 2021/0219811 A1 Jul. 22, 2021

(51) Int. Cl.

| | |
|---|---|
| ***A47L 15/42*** | (2006.01) |
| ***A47L 15/22*** | (2006.01) |
| ***A47L 15/23*** | (2006.01) |

(52) U.S. Cl.

CPC ..... *A47L 15/4221* (2013.01); *A47L 15/22* (2013.01); *A47L 15/23* (2013.01); *A47L 15/4225* (2013.01)

(58) Field of Classification Search

CPC ..... A47L 15/4221; A47L 15/22; A47L 15/23; A47L 15/4225

See application file for complete search history.

(56) References Cited

U.S. PATENT DOCUMENTS

| | | | | |
|---|---|---|---|---|
| 5,655,556 | A | 8/1997 | Guerrera et al. | |
| 9,027,578 | B2 | 5/2015 | Boyer et al. | |
| 10,206,553 | B2 | 2/2019 | Ross et al. | |
| 2011/0203619 | A1 | 8/2011 | Kara et al. | |
| 2017/0071444 | A1* | 3/2017 | Hofmann | A47L 15/4221 |
| 2018/0360293 | A1* | 12/2018 | Boyer | A47L 15/46 |

FOREIGN PATENT DOCUMENTS

| | | | |
|---|---|---|---|
| EP | 1040787 | B1 | 10/2000 |

* cited by examiner

*Primary Examiner* — Michael E Barr
*Assistant Examiner* — Pallavi Chitta
(74) *Attorney, Agent, or Firm* — Dority & Manning, P.A.

(57) ABSTRACT

A dishwashing appliance and a spray assembly, as provided herein, may include a manifold body, and a cammed diverter valve. The manifold body may be mountable within a wash chamber. The manifold body may define a fluid inlet, a first spray zone, and a second spray zone. The first spray zone may include a first spray outlet. The second spray zone may include a second spray outlet spaced apart from the first spray outlet. The cammed diverter valve may be mounted within the manifold body and be movable between a first zone position and a second zone position. The first zone position may direct wash fluid to the first spray zone and restrict wash fluid to the second spray zone. The second zone position may direct wash fluid to the second spray zone and restrict wash fluid to the first spray zone.

18 Claims, 8 Drawing Sheets

DISHWASHING APPLIANCE HAVING A MULTI-ZONE SPRAY ASSEMBLY TO ALTERNATE THE SPRAY OF WASH FLUID

FIELD OF THE INVENTION

The present subject matter relates generally to washer appliances, and more particularly to dishwashing appliances having one or more multi-zone spray assemblies.

BACKGROUND OF THE INVENTION

A dishwasher or dishwashing appliances generally includes a tub that defines a wash chamber for receipt of articles for washing. Certain dishwashing appliances also include a rack assembly slidably mounted within the wash chamber. A user can load articles, such as plates, bowls, glasses, or cups, into the rack assembly, and the rack assembly can support such articles within the wash chamber during operation of the dishwashing appliance.

Typically, a dishwasher or dishwashing appliance has multiple locations at which fluids must be delivered for cleaning and rinsing articles into the chamber of the dishwasher. For example, the dishwasher may include multiple spray body assemblies such as one under a bottom dishwasher rack and another under the top dishwasher rack. An additional spray device may also be provided over the top dishwasher rack. Some dishwashers may also include a fluid spray specifically for a basket or other compartment that holds silverware.

A common concern with many spray assemblies is maintaining a relatively high pressure for the spray in order to ensure articles are adequately washed (e.g., such that residue or sediment can be dislodged from articles within the wash chamber). Maintaining adequate pressure across an extended area (e.g., rack) often requires relatively large volumes of water to be sprayed, which can make it especially difficult to also comply with modern regulations regarding permissible water use. Additionally or alternatively, it can be difficult to ensure each portion of the extended area (e.g., rack) or wash chamber is reached by the spray assembly. For instance, rotating spray arms are common in modern spray assemblies. During rotation, such spray arms generally define a circular spray area. Nonetheless, wash chambers generally have a rectangular or square cross-section. Thus, it can be difficult to direct wash fluid towards certain portions of the wash chamber with such rotating spray arms.

Accordingly, it would be advantageous to provide a spray assembly for a dishwashing appliance with features for ensuring a spray maintains a relatively high pressure across an extended area. Additionally or alternatively, it would be useful for the relatively high pressure spray is provided while using a relatively small volume of water.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a spray assembly for a dishwashing appliance is provided. The spray assembly may include a manifold body, and a cammed diverter valve. The manifold body may be mountable within a wash chamber of the dishwashing appliance. The manifold body may define a fluid inlet, a first spray zone, and a second spray zone. The fluid inlet may receive a wash fluid within the manifold body. The first spray zone may be downstream from the fluid inlet and may include a first spray outlet. The second spray zone may be downstream from the fluid inlet and may include a second spray outlet spaced apart from the first spray outlet. The cammed diverter valve may be mounted within the manifold body upstream from the first and second spray zones. The cammed diverter valve may be movable between a first zone position and a second zone position. The first zone position may direct wash fluid to the first spray zone and restrict wash fluid to the second spray zone. The second zone position may direct wash fluid to the second spray zone and restrict wash fluid to the first spray zone.

In another exemplary aspect of the present disclosure, a dishwashing appliance is provided. The dishwashing appliance may include a tub, a pump, a rack assembly; and a spray assembly. The tub may define a wash chamber. The pump may be configured to deliver a wash fluid into the wash chamber. The rack assembly may be slidably disposed within the wash chamber. The spray assembly may be housed within the wash chamber of the tub in fluid communication with the pump to receive wash fluid therefrom. The spray assembly may include a manifold body and a cammed diverter valve. The manifold body may define a fluid inlet, a first spray zone, and a second spray zone. The fluid inlet may receive the wash fluid within the manifold body. The first spray zone may be downstream from the fluid inlet and may include a first spray outlet directed to the wash chamber. The second spray zone may be downstream from the fluid inlet and the include a second spray outlet directed to the wash chamber and spaced apart from the first spray outlet. The cammed diverter valve may be mounted within the manifold body upstream from the first and second spray zones. The cammed diverter valve may be movable between a first zone position and a second zone position. The first zone position may direct wash fluid to the first spray zone and restrict wash fluid to the second spray zone. The second zone position may direct wash fluid to the second spray zone and restrict wash fluid to the first spray zone.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
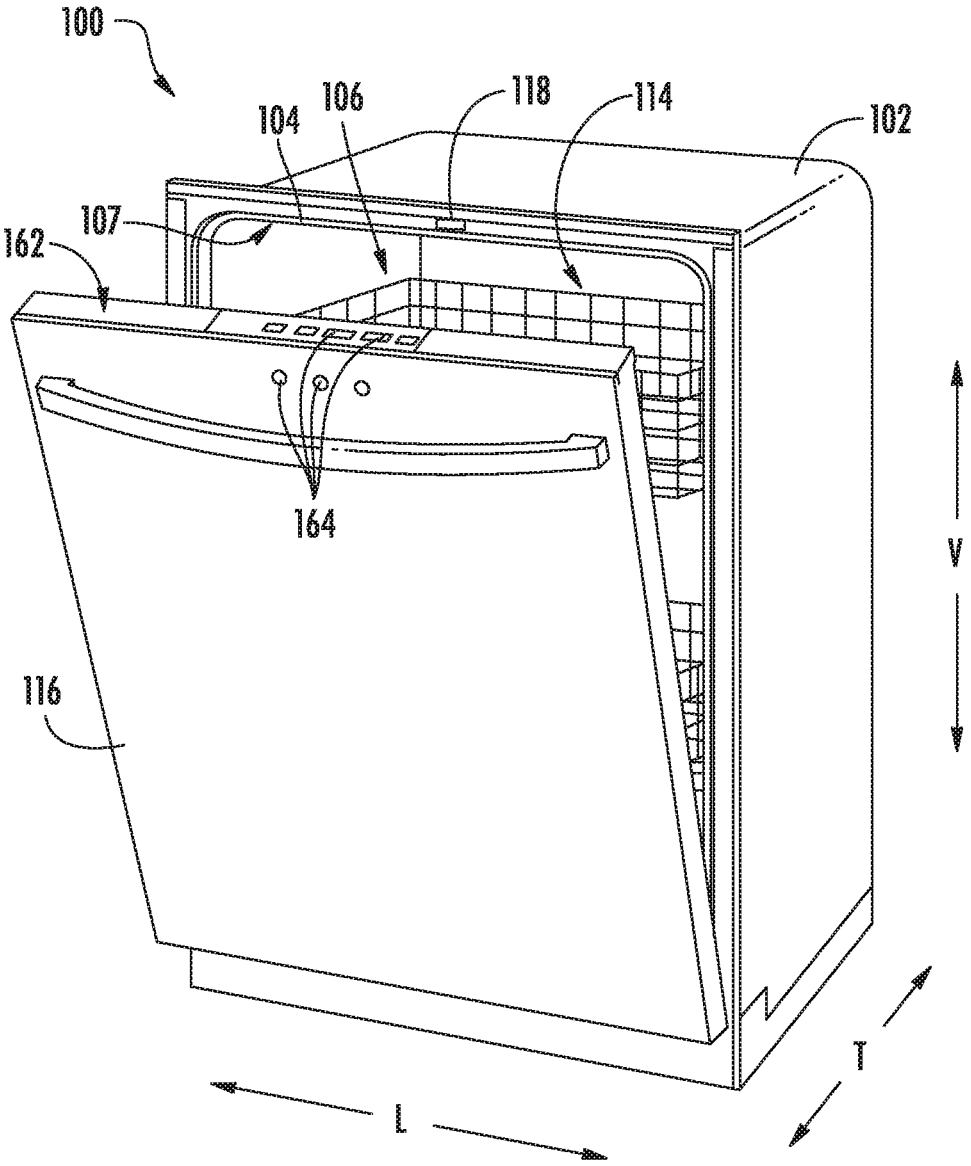
FIG. 1 provides a perspective view of an exemplary embodiment of a dishwashing appliance of the present disclosure with a door in a partially open position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a wash fluid (e.g., water, detergent, or wash additive). The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing or rinsing the articles that is typically made up of water and may include additives, such as detergent or other treatments (e.g., rinse aid). Furthermore, as used herein, terms of approximation, such as "approximately," "substantially," or "around," refer to being within a ten percent (10%) margin of error.

Figure 2:
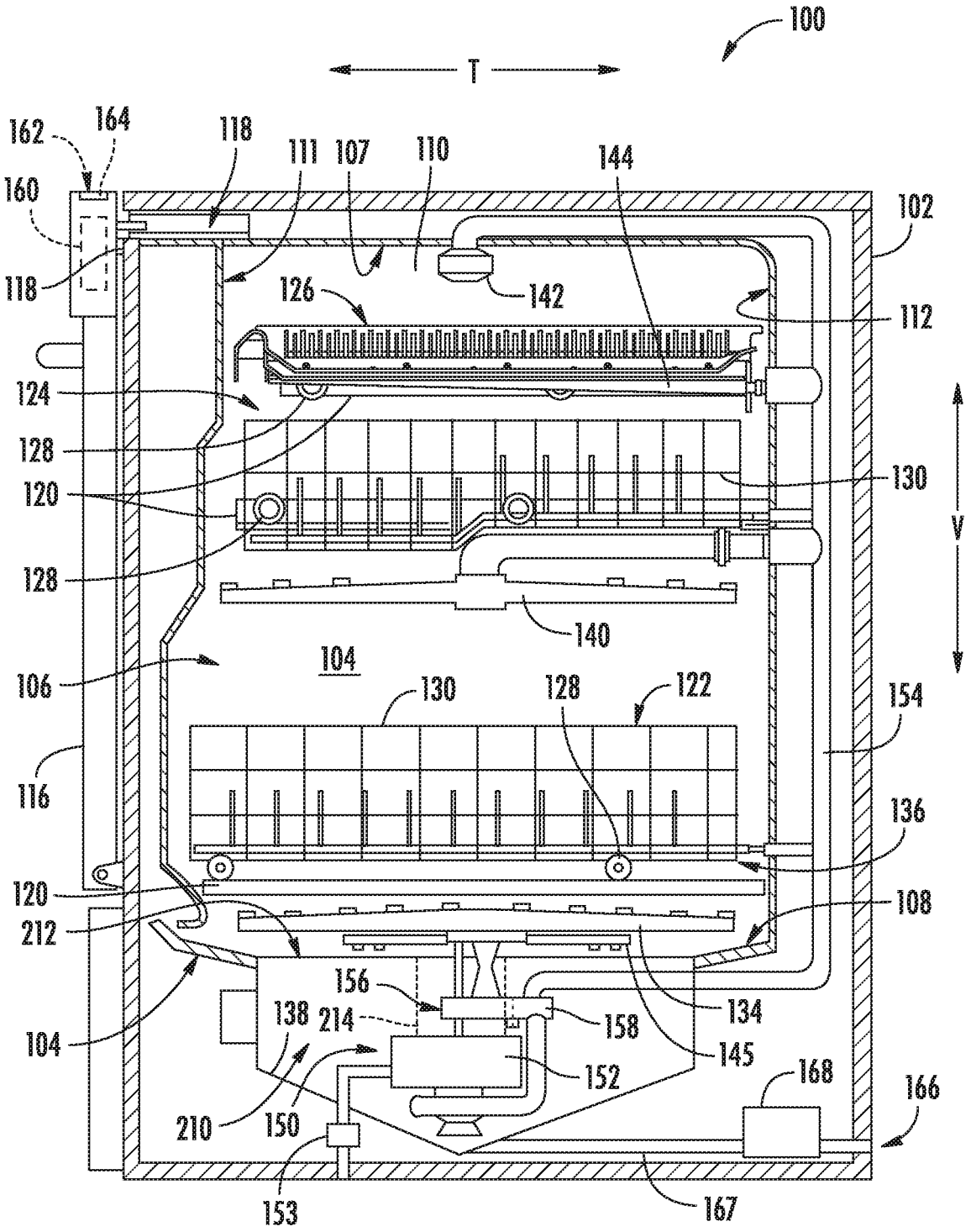
FIG. 2 provides a side, sectional view of the exemplary dishwashing appliance of FIG. 1.

Turning now to the figures, FIGS. 1 and 2 depict an exemplary dishwasher or dishwashing appliance (e.g., dishwasher 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114. In some embodiments, a door 116 hinged at its bottom for movement between a normally closed vertical position, wherein the wash chamber 106 is sealed shut for washing operation, and a horizontal open position for loading and unloading of articles from dishwasher 100. A door closure mechanism or assembly 118 may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122, a middle rack assembly 124, or an upper rack assembly 126. In some such embodiments, upper rack assembly 126 is positioned at a top portion of wash chamber 106 above middle rack assembly 124, which is positioned above lower rack assembly 122 along the vertical direction V.

Generally, each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. In some embodiments, movement is facilitated, for instance, by rollers 128 mounted onto rack assemblies 122, 124, 126, respectively.

Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to additional or alternative embodiments, a silverware basket (not shown) is removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash fluid) onto the articles placed within wash chamber 106.

In exemplary embodiments, dishwasher 100 includes a lower spray arm assembly 134 disposed in a lower region 136 of wash chamber 106 and above a sump 138 so as to rotate in relatively close proximity to lower rack assembly 122.

In additional or alternative embodiments, a mid-level spray arm assembly 140 is located in an upper region of wash chamber 106 (e.g., below and in close proximity to middle rack assembly 124). In this regard, mid-level spray arm assembly 140 may generally be configured for urging a flow of wash fluid up through middle rack assembly 124 and upper rack assembly 126.

In further additional or alternative embodiments, an upper spray assembly 142 is located above upper rack assembly 126 along the vertical direction V. In this manner, upper spray assembly 142 may be generally configured for urging or cascading a flow of wash fluid downward over rack assemblies 122, 124, and 126.

In yet further additional or alternative embodiments, upper rack assembly 126 may further include or be attached to a spray manifold 144. As illustrated, spray manifold 144 may be directed upward, and thus generally configured for urging a flow of wash fluid substantially upward along the vertical direction V through upper rack assembly 126.

In still further additional or alternative embodiments, a filter clean spray assembly 145 is disposed in a lower region 136 of wash chamber 106 (e.g., below lower spray arm assembly 134) and above a sump 138 so as to rotate in relatively close proximity to a filter assembly 210. For instance, filter clean spray assembly 145 may be directed downward to urge a flow of wash fluid across a portion of filter assembly 210 (e.g., first filter 212) or sump 138.

The various spray assemblies and manifolds described herein may be part of a fluid distribution system or fluid circulation assembly 150 for circulating wash fluid in tub 104. In certain embodiments, fluid circulation assembly 150 includes a circulation pump 152 for circulating wash fluid in tub 104. Circulation pump 152 may be located within sump 138 or within a machinery compartment located below sump 138 of tub 104.

When assembled, circulation pump 152 may be in fluid communication with an external water supply line and sump 138. A water inlet valve 153 can be positioned between the external water supply line and circulation pump 152 (e.g., to selectively allow water to flow from the external water supply line to circulation pump 152). Additionally or alternatively, water inlet valve 153 can be positioned between the external water supply line and sump 138 (e.g., to selectively allow water to flow from the external water supply line to sump 138). During use, water inlet valve 153 may be selectively controlled to open to allow the flow of water into dishwasher 100 and may be selectively controlled to cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 2, a primary supply conduit 154 extends from circulation pump 152, along rear 112 of tub 104 along the vertical direction V to supply wash fluid throughout wash chamber 106.

In some embodiments, primary supply conduit 154 is used to supply wash fluid to one or more spray assemblies (e.g., to mid-level spray arm assembly 140, upper spray assembly 142, or spray manifold 144). It should be appreciated, however, that according to alternative embodiments, any other suitable plumbing configuration may be used to supply wash fluid throughout the various spray manifolds and assemblies described herein. For instance, according to another exemplary embodiment, primary supply conduit 154 could be used to provide wash fluid to mid-level spray arm assembly 140 and a dedicated secondary supply conduit (not shown) could be used to provide wash fluid to upper spray assembly 142 or spray manifold 144. Other plumbing configurations may be used for providing wash fluid to the various spray devices and manifolds at any location within dishwasher 100.

Each spray assembly 134, 140, 142, 144 may include an arrangement of discharge ports or orifices for directing wash fluid received from circulation pump 152 onto dishes or other articles located in wash chamber 106. In, for example, the case of spray arm assemblies 134, 140 The arrangement of the discharge ports, also referred to as jets, apertures, or orifices, may provide a rotational force by virtue of wash fluid flowing through the discharge ports. Additionally or alternatively, spray arm assemblies 134, 140 may be motor-driven, or may operate using any other suitable drive mechanism. Spray manifolds and assemblies may also be stationary. The resultant movement of the spray arm assemblies 134, 140 and the spray from fixed manifolds (e.g., 142, 144) provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In some embodiments, an exemplary filter assembly 210 is provided. As shown, in exemplary embodiments, filter assembly 210 is located in the sump 138 (e.g., to filter fluid to circulation assembly 150). Generally, filter assembly 210 removes soiled particles from the fluid that is recirculated through the wash chamber 106 during operation of dishwasher 100. In exemplary embodiments, filter assembly 210 includes both a first filter 212 (also referred to as a "coarse filter") and a second filter 214 (also referred to as a "fine filter").

In some embodiments, the first filter 212 is constructed as a grate having openings for filtering fluid received from wash chamber 106. The sump 138 includes a recessed portion upstream from circulation pump 152 or a drain pump 168 and over which the first filter 212 is removably received. In exemplary embodiments, the first filter 212 operates as a coarse filter having media openings in the range of about 0.030 inches to about 0.060 inches. The recessed portion may define a filtered volume wherein debris or particles have been filtered by the first filter 212 or the second filter 214.

In additional or alternative embodiments, the second filter 214 is provided upstream from circulation pump 152 or drain pump 168. Second filter 214 may be non-removable or, alternatively, may be provided as a removable cartridge positioned in a tub receptacle formed in sump 138. For instance, the second filter 214 may be removably positioned within a collection chamber defined by the tub receptacle. The second filter 214 may be generally shaped to complement the tub receptacle. For instance, the second filter 214 may include a filter wall that complements the shape of the tub receptacle. In some embodiments, the filter wall is formed from one or more fine filter media. Some such embodiments may include filter media (e.g., screen or mesh, having pore or hole sizes in the range of about 50 microns to about 600 microns).

During operation of some embodiments (e.g., during or as part of a wash cycle or rinse cycle), circulation pump 152 draws wash fluid in from sump 138 through filter assembly (e.g., through first filter 212 or second filter 214). Thus, circulation pump 152 may be downstream from filter assembly 210.

In optional embodiments, circulation pump 152 urges or pumps wash fluid (e.g., from filter assembly 210) to a diverter 156. In some such embodiments, diverter 156 is positioned within sump 138 of dishwasher 100). Diverter 156 may include a diverter disk (not shown) disposed within a diverter chamber 158 for selectively distributing the wash fluid to the spray assemblies 134, 140, 142, or other spray manifolds. For instance, the diverter disk may have a plurality of apertures that are configured to align with one or more outlet ports (not shown) at the top of diverter chamber 158. In this manner, the diverter disk may be selectively rotated to provide wash fluid to the desired spray device.

In exemplary embodiments, diverter 156 is configured for selectively distributing the flow of wash fluid from circulation pump 152 to various fluid supply conduits—only some of which are illustrated in FIG. 2 for clarity. In certain embodiments, diverter 156 includes multiple outlet ports (not shown) for supplying wash fluid to multiple discrete conduits. For instance, one or more outlets and corresponding conduits may be included for supplying wash fluid to lower spray arm assembly 134. An additional or alternative outlet and conduit may be included for supplying wash fluid to filter clean assembly 145. Another additional or alternative outlet and conduit may be included for supplying wash fluid to spray manifold 144. Yet another additional or alternative outlet and conduit may be included for supplying wash fluid to mid-level spray assembly 140. Still additional or alternative outlet and conduit may be included for supplying wash fluid to upper spray assembly 142.

Drainage of soiled wash fluid within sump 138 may occur, for instance, through drain assembly 166 (e.g., during or as part of a drain cycle). In particular, wash fluid may exit sump 138 through a drain and may flow through a drain conduit 167. In some embodiments, a drain pump 168 downstream from sump 138 facilitates drainage of the soiled wash fluid by urging or pumping the wash fluid to a drain line external to dishwasher 100. Drain pump 168 may be downstream from first filter 212 or second filter 214. Additionally or alternatively, an unfiltered flow path may be defined through sump 138 to drain conduit 167 such that an unfiltered fluid flow may pass through sump 138 to drain conduit 167 without first passing through either first filter 212 or second filter 214.

Although a separate recirculation pump 152 and drain pump 168 are described herein, it is understood that other suitable pump configurations (e.g., using only a single pump for both recirculation and draining) may be provided.

In certain embodiments, dishwasher 100 includes a controller 160 configured to direct or control operation of dishwasher 100 (e.g., initiate one or more wash operations). Controller 160 may include one or more memory devices and one or more microprocessors, such as general or special purpose microprocessors operable to execute programming instructions or micro-control code associated with a wash operation that may include a wash cycle, rinse cycle, or drain cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry—such as switches, amplifiers, integrators, comparators, flip-flops, AND gates, and the like—to perform control functionality instead of relying upon software).

Controller 160 may be positioned in a variety of locations throughout dishwasher 100. In optional embodiments, controller 160 is located within a control panel area 162 of door 116 (e.g., as shown in FIGS. 1 and 2). Input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In some embodiments, user interface 164 includes a general purpose I/O ("GPIO") device or functional block. In additional or alternative embodiments, user interface 164 includes input components, such as one or more of a variety of electrical, mechanical or electromechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For instance, different locations may be provided for user interface 164, different configurations may be provided for rack assemblies 122, 124, 126, different configurations may be provided for alternative spray assemblies or spray assemblies 134, 140, 142, 144, 145, and other differences may be applied while remaining within the scope of the present disclosure.

Turning now to FIGS. 3 through 7D, various views are provided illustrating a spray assembly 300 according to exemplary embodiments of the present disclosure. When assembled, spray assembly 300 may be mounted on or within a corresponding dishwashing appliance (e.g., dishwasher 100—FIG. 2), such as within wash chamber 102. For example, spray assembly 300 may be provided as or as part of spray manifold 144 on rack assembly 126 (FIG. 2). In additional or alternative examples, spray assembly 300 may be provided as or as part of another spray assembly within wash chamber 102 (e.g., spray assembly 138, 140, 142, or 145—FIG. 2).

Generally, spray assembly 300 includes a manifold body 310 defining a fluid inlet 328 and multiple spray zones (e.g., spray zones 312, 314, 316, 318) downstream therefrom. Within the manifold body 310, an enclosed cavity 320 may be defined (e.g., downstream from the fluid inlet 328 and upstream from the spray zones). As will be described in greater detail below, a cammed diverter valve 322 is mounted within manifold body 310 (e.g., within enclosed cavity 320) upstream from the spray zones to selectively and separately direct wash fluid from the fluid inlet 328 to the spray zones.

In some embodiments, manifold body 310 includes an outlet plate 324 and a base pan 326. When assembled, the manifold body 310 may be attached (e.g., selectively or, alternatively, fixedly) to base pan 326. Together, outlet plate 324 and base pan 326 may define the enclosed cavity 320 (e.g., between outlet plate 324 and base pan 326) within which wash fluid may flow from the fluid inlet 328. In exemplary embodiments, outlet plate 324 is disposed above or on top of base pan 326. Thus, outlet plate 324 may define an upper internal surface 330 of manifold body 310. Additionally or alternatively, base pan 326 may define a lower internal surface 332 of manifold body 310.

As noted above, fluid inlet 328 is defined upstream from enclosed cavity 320. In optional embodiments, fluid inlet 328 is defined through a sidewall of base pan 326 (e.g., as part of a flared nozzle). For instance, fluid inlet 328 may be defined through a rear sidewall of base pan 326 facing or proximal to the rear 112 (FIG. 2) of wash chamber 102. Additional or alternative embodiments, however, may define fluid inlet 328 at or through another suitable portion of manifold body 310 generally, or base pan 326 in particular.

Figure 3:
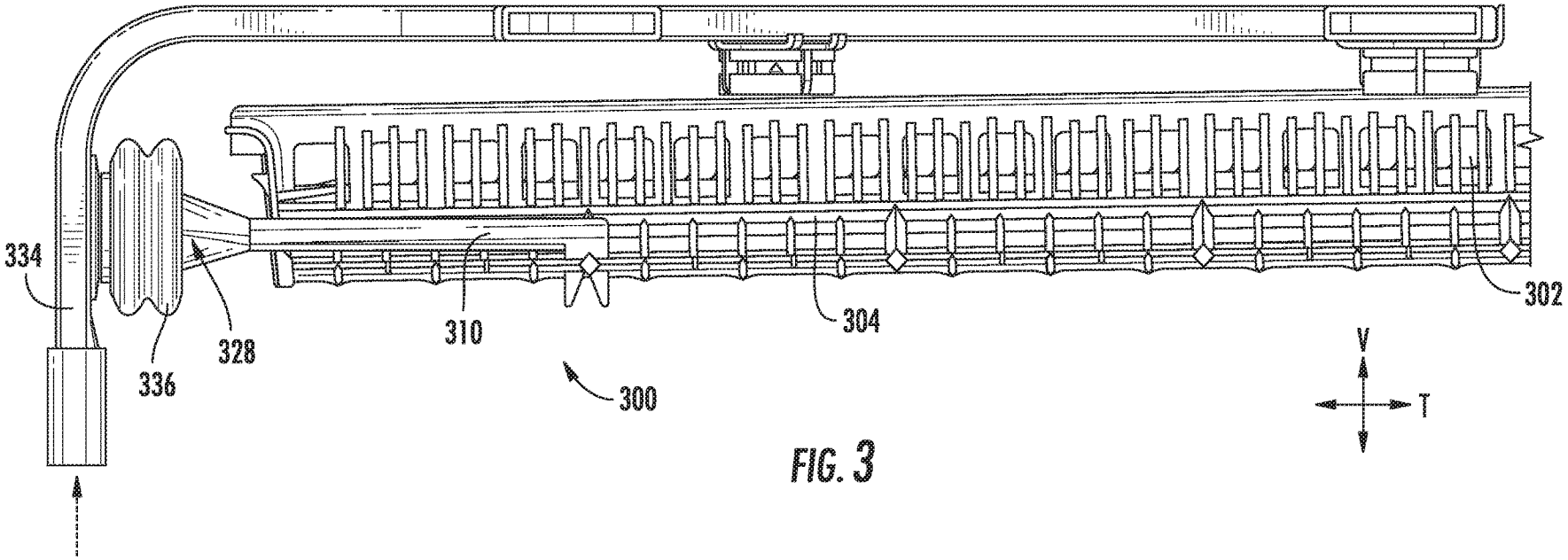
FIG. 3 provides a side, elevation view of a rack and a multi-zone spray assembly of the exemplary dishwashing appliance of FIG. 1.
Figure 4A:
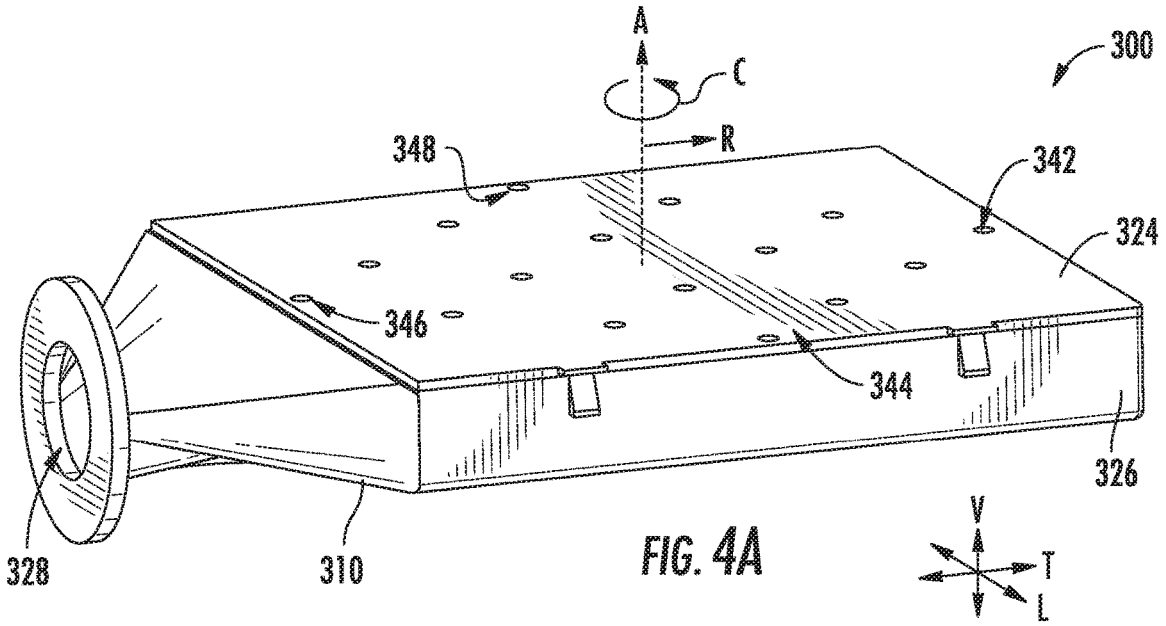
FIG. 4A provides an assembled, perspective view of the multi-zone spray assembly according to exemplary embodiments of the present disclosure.
Figure 4B:
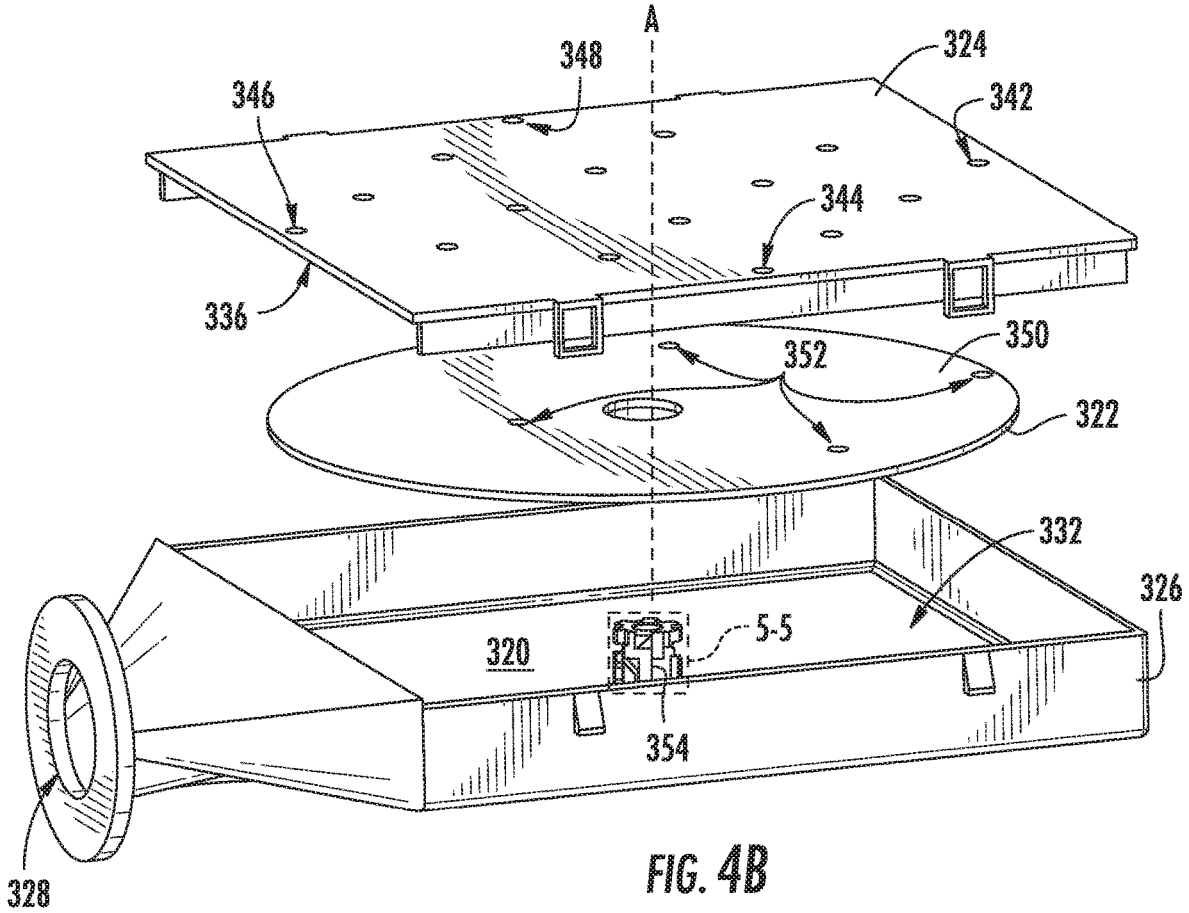
FIG. 4B provides an exploded, perspective view of the multi-zone spray assembly according to exemplary embodiments of the present disclosure.
Figure 5:
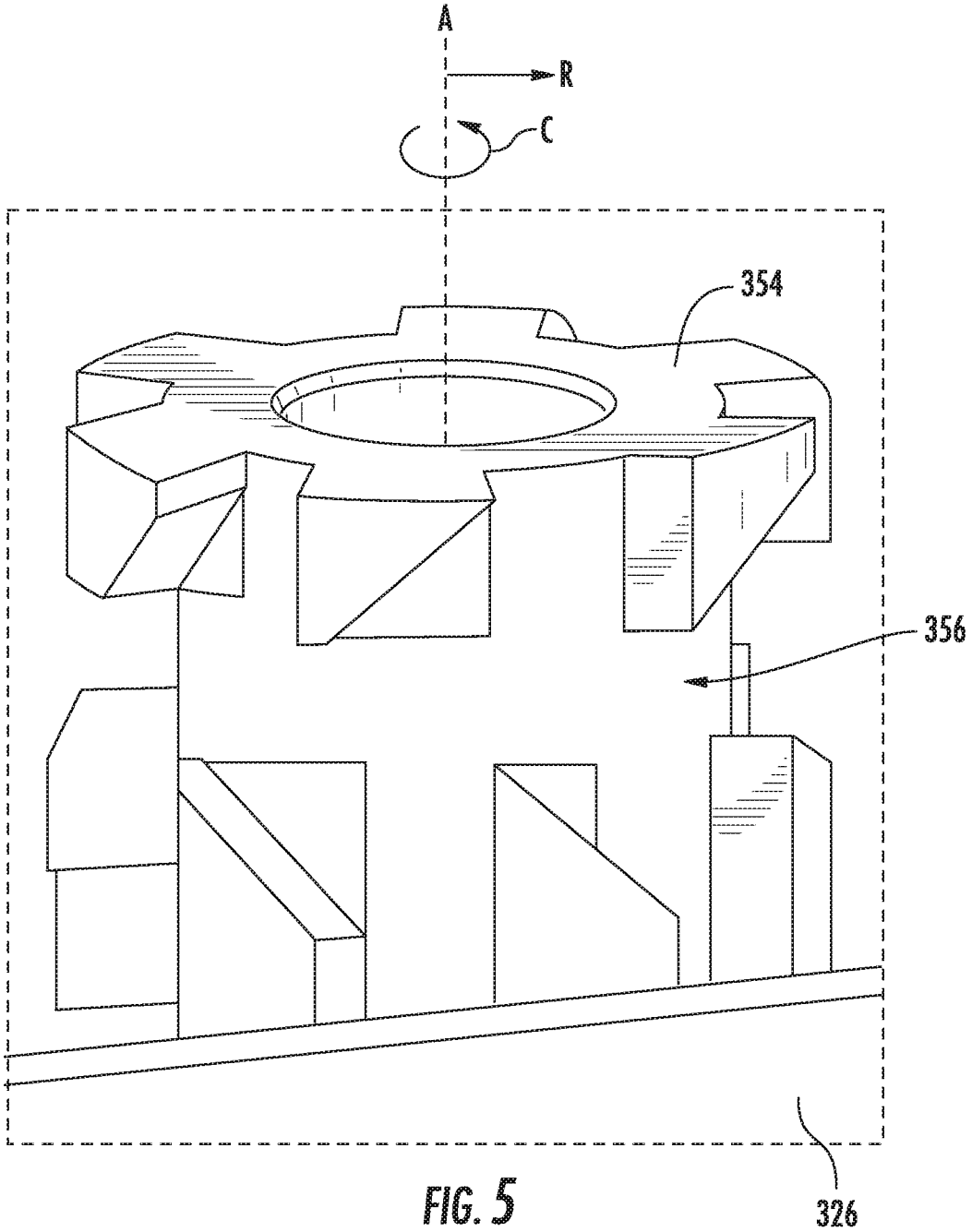
FIG. 5 provides a magnified, perspective view of the portion of the exemplary multi-zone spray assembly within the region 5-5 of FIG. 4B.

Turning especially to FIG. 3, in optional embodiments, manifold body 310 is mounted to a slidable rack 302, such as upper rack assembly 126 (FIG. 2). Generally, the slidable rack 302 may be downstream from manifold body 310 (e.g., the spray zones thereof). For instance, manifold body 310 may be mounted to the bottom wall 304 of the slidable rack 302 to spray wash fluid upward into the slidable rack 302. Optionally, one or more suitable mechanical fasteners (e.g., clips, ties, snaps, etc.) may secure the manifold body 310 to a lattice member of the slidable rack 302 along the bottom wall 304 of the slidable rack 302. During use, manifold body 310 is static relative to slidable rack 302. In some embodiments, manifold body 310 is fixed to slidable rack 302 and may thus move therewith.

Optionally, manifold body 310 may selectively connect to a fluid conduit 334 fixed within wash chamber 102, such as at the rear wall 112 (FIG. 2). During washing operations, fluid inlet 328 may receive wash fluid from the fluid conduit 334, as described below. By contrast, outside of or between washing operations (e.g., during the loading and unloading of slidable rack 302), the connection between manifold body 310 and the fluid conduit 334 may be alternately formed and broken as the manifold body 310 slides into and out of wash chamber 102 (e.g., with slidable rack 302). In certain embodiments, the fluid conduit 334 includes a resilient bellow 336 extending from the outlet of fluid conduit 334. The resilient bellow 336 may extend toward the fluid inlet 328 (e.g., in contact with manifold body 310 about fluid inlet 328). The resilient bellow 336 may be formed to generally compressible engaged with the manifold body 310. Conversely, the resilient bellow 336 may expand outward (e.g., away from the fluid outlet of the fluid conduit 334) when manifold body 310 is removed from engagement therewith. When connected, wash fluid may flow from the fluid conduit 334, through the resilient bellow 336, into the fluid inlet 328. The resilient bellow 336 may be formed from a suitable elastic material, such as one or more polymer or rubber material.

In optional embodiments, the shape of manifold body 310 (e.g., at outlet plate 324) generally complements or mirrors the shape of slidable rack 302. As an example, outlet plate 324 may be formed as a rectangular shape extending the across substantially the entire width of slidable rack 302 along the lateral direction L. As an additional or alternative example, outlet plate 324 may be formed as a rectangular shape extending the across substantially the entire length of slidable rack 302 along the transverse direction T or, alternatively, across merely a subportion of the entire length of slidable rack 302 (e.g., as illustrated in FIG. 3).

Although manifold body 310 is illustrated as being mounted to a bottom wall 304 of the slidable rack 302, another suitable location or orientation of manifold body 310 to slidable rack 302 may be provided in which the slidable rack 302 is downstream from the spray zones of manifold body 310, as would be understood in light of the present disclosure.

The spray zones (e.g., spray zones 312, 314, 316, 318) of manifold body 310 each generally include one or more spray outlets (e.g., spray outlets 342, 344, 346, 348) that define the region or area in which wash fluid from the spray assembly 300 can be received (e.g., during a wash cycle or rinse cycle). The spray outlets may be defined in fluid parallel to each other such that a volume of wash fluid is not forced to flow through one spray outlet before entering another. Additionally or alternatively, wash fluid may be permitted through multiple spray outlets simultaneously. As shown, spray outlets 342, 344, 346, 348 may be spaced apart from each other (e.g., in a direction perpendicular to the vertical direction V or a central axis A). In exemplary embodiments, the spray outlets (e.g., spray outlets 342, 344, 346, 348) extend generally along the vertical direction V (e.g., at an angle parallel or nonorthogonal to the vertical direction V), as is illustrated. Nonetheless, additional or alternative embodiments may include spray outlets at any suitable angle to direct a spray of wash fluid to articles within the slidable rack 302 or wash chamber 102.

Optionally, spray outlets 342, 344, 346, 348 (and thus spray zones 312, 314, 316, 318, generally) may be defined by outlet plate 324. For instance, one or more spray outlets 342, 344, 346, 348 may extend through outlet plate 324 from the enclosed cavity 32. At least a portion of wash fluid within wash chamber 106 may thus be forced through outlet plate 324 via one or more of the spray outlets 342, 344, 346, 348.

Figure 7B:
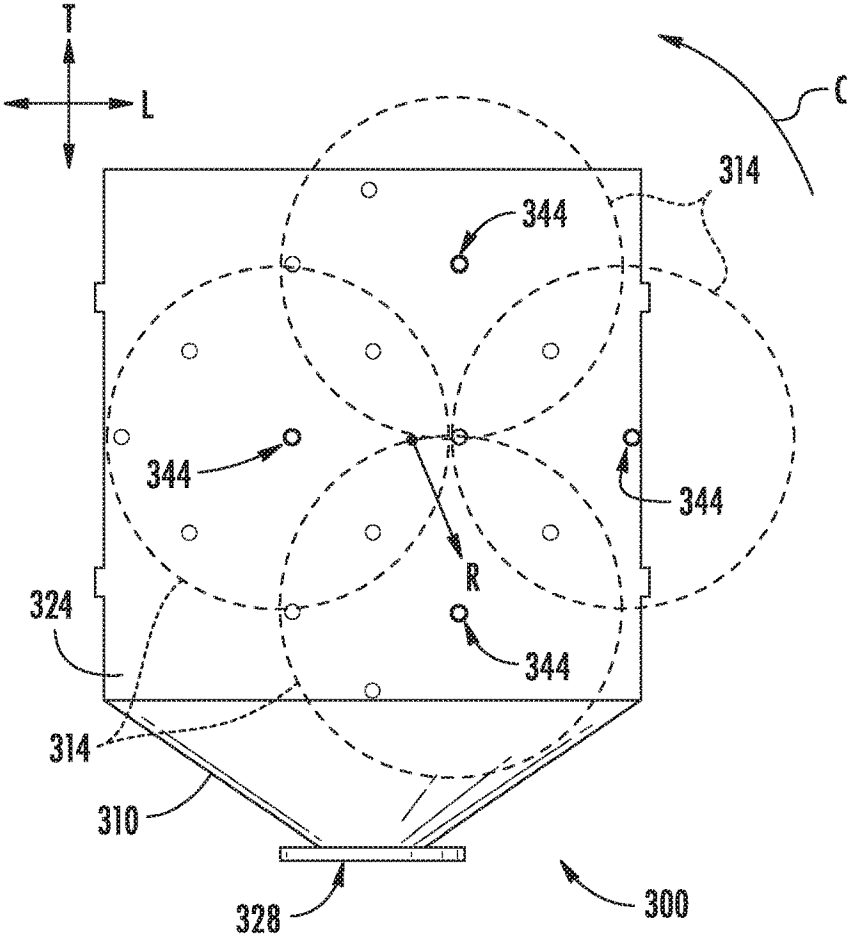
FIG. 7B provides a top, perspective view of the multi-zone spray assembly according to exemplary embodiments of the present disclosure, wherein a diverter valve is in an active second zone position.
Figure 7A:
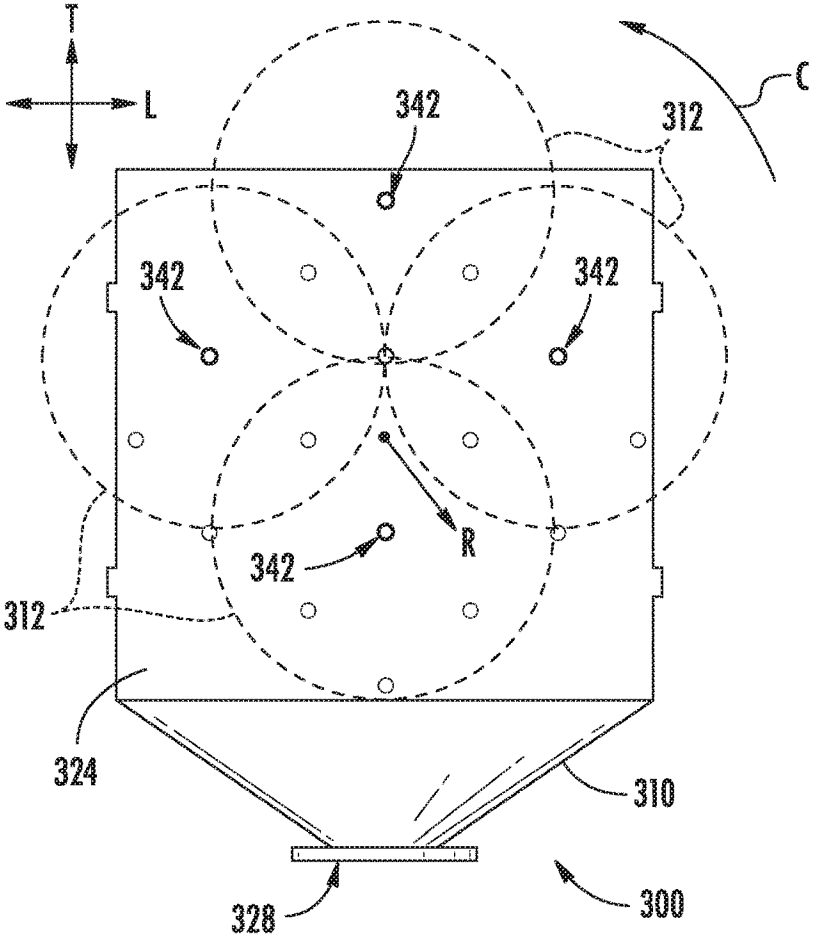
FIG. 7A provides a top, perspective view of the multi-zone spray assembly according to exemplary embodiments of the present disclosure, wherein a diverter valve is in an active first zone position.
Figure 7D:
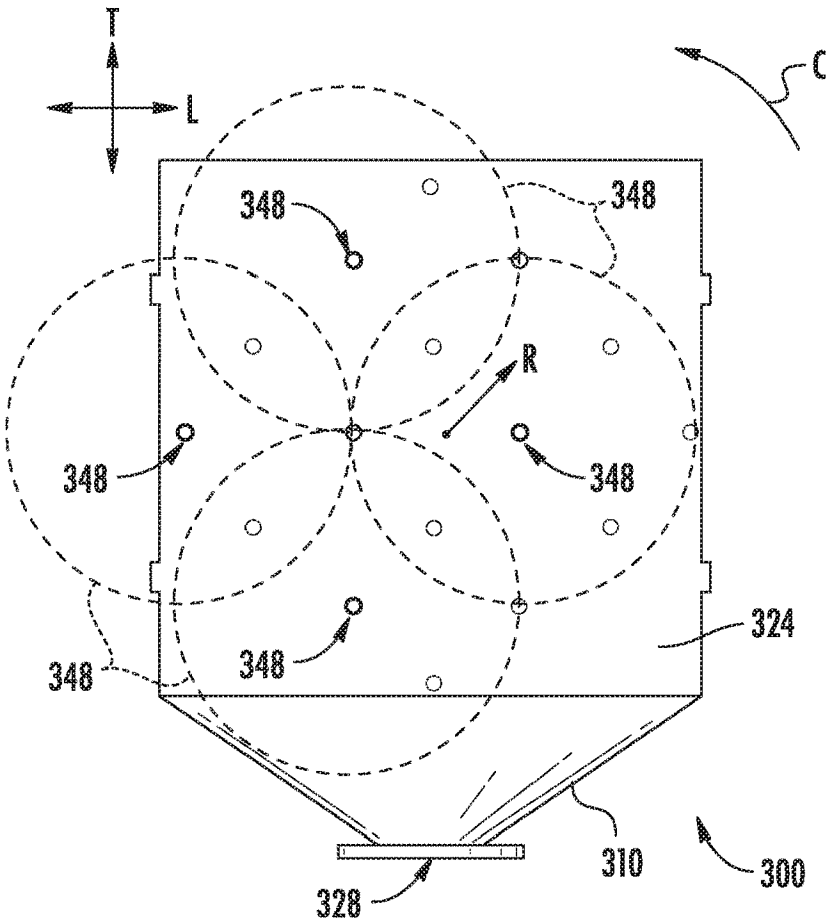
FIG. 7D provides a top, perspective view of the multi-zone spray assembly according to exemplary embodiments of the present disclosure, wherein a diverter valve is in an active fourth zone position.
Figure 7C:
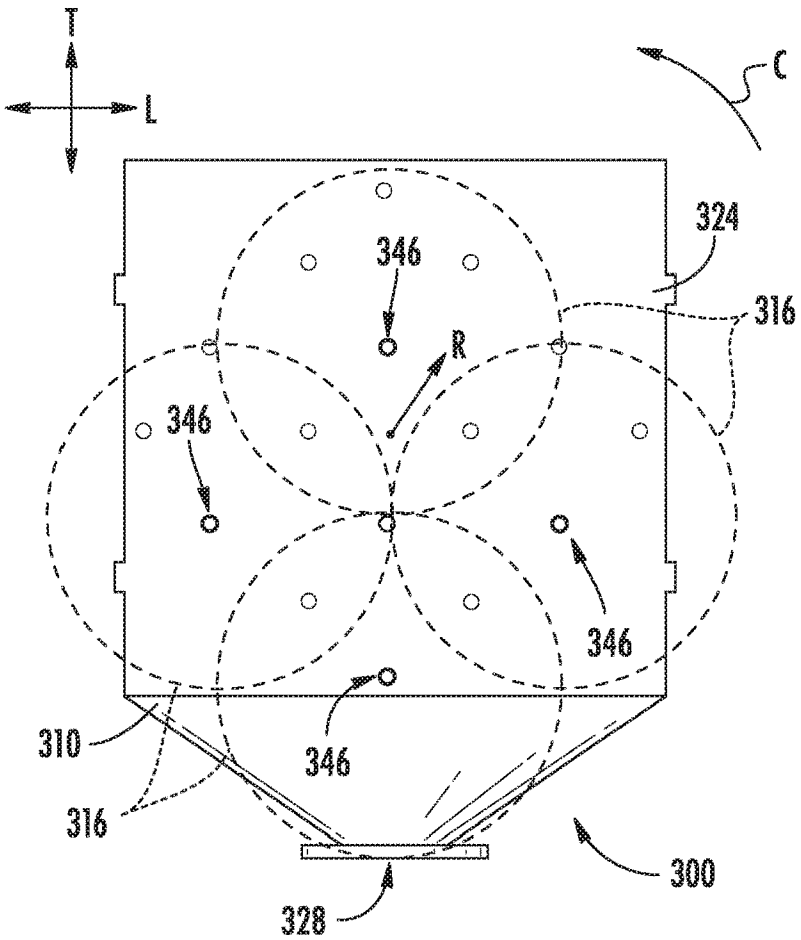
FIG. 7C provides a top, perspective view of the multi-zone spray assembly according to exemplary embodiments of the present disclosure, wherein a diverter valve is in an active third zone position.

Turning especially to FIGS. 7A through 7D, exemplary embodiments are illustrated by manifold body 310 defines four discrete spray zones. In particular, a first spray zone 312 is illustrated at FIG. 7A; a second spray zone 314 is illustrated at FIG. 7B; a third spray zone 316 is illustrated at FIG. 7C; and a fourth spray zone 318 is illustrated at FIG. 7D.

As illustrated in FIG. 7A, first spray zone 312 may include a plurality of first spray outlets 342. In some embodiments, the plurality of first spray outlets 342 are spaced apart from each other (e.g., on outlet plate 324 along a direction perpendicular to the central axis A, such as a circumferential direction C). Additionally or alternatively, two or more of the first spray outlets 342 may be radially spaced apart such that discrete first spray outlets 342 are defined at discrete radial distances from the central axis A.

As illustrated in FIG. 7B, second spray zone 314 may include a plurality of second spray outlets 344. In some embodiments, the plurality of second spray outlets 344 are spaced apart from each other (e.g., on outlet plate 324 along a direction perpendicular to the central axis A, such as the circumferential direction C). Additionally or alternatively, two or more of the second spray outlets 344 may be radially spaced apart such that discrete second spray outlets 344 are defined at discrete radial distances from the central axis A. Further additionally or alternatively, one or more of the second spray outlets 344 may be circumferentially or radially spaced apart from one or more of the first spray outlets 342.

As illustrated in FIG. 7C, third spray zone 316 may include a plurality of third spray outlets 346. In some embodiments, the plurality of third spray outlets 346 are spaced apart from each other (e.g., on outlet plate 324 along a direction perpendicular to the central axis A, such as the circumferential direction C). Additionally or alternatively, two or more of the third spray outlets 346 may be radially spaced apart such that discrete third spray outlets 346 are defined at discrete radial distances from the central axis A. Further additionally or alternatively, one or more of the third spray outlets 346 may be circumferentially or radially spaced apart from one or more of the first spray outlets 342 or second spray outlets 344.

As illustrated in FIG. 7D, fourth spray zone 318 may include a plurality of fourth spray outlets 348. In some embodiments, the plurality of fourth spray outlets 348 are spaced apart from each other (e.g., on outlet plate 324 along a direction perpendicular to the central axis A, such as the circumferential direction C). Additionally or alternatively, two or more of the fourth spray outlets 348 may be radially spaced apart such that discrete fourth spray outlets 348 are defined at discrete radial distances from the central axis A. Further additionally or alternatively, one or more of the second spray outlets 344 may be circumferentially or radially spaced apart from one or more of the first spray outlets 342, second spray outlets 344, or third spray outlets 346.

In optional embodiments, two or more of the spray zones overlap with each other. For instance, first spray zone 312 may overlap with second spray zone 314, third spray zone 316, or fourth spray zone 318. As shown, overlapping spray zones may provide spray outlets that are mixed with each other. Thus, while overlapping spray zones may cover different regions or areas of wash chamber 102, at least a portion of the regions covered by overlapping spray zones may advantageously be shared. In other words, at least some of the region sprayed with wash fluid by one spray zone may also be sprayed by another overlapping spray zone. In some embodiments, one or more spray outlets of one spray zone (e.g., second spray zone 314) are disposed between otherwise adjacent spray outlets of another spray zone (e.g., first spray zone 312).

As noted above, a cammed diverter valve 322 may be movably mounted on manifold body 310 (e.g., within the enclosed cavity 320) downstream from fluid inlet 328 and upstream from the spray zones 312, 314, 316, 318. Specifically, cammed diverter valve 322 may be mounted to move between multiple active positions corresponding to the spray zones. During use in a particular active position, cammed diverter valve 322 may advantageously direct wash fluid from the enclosed cavity 320 to the corresponding spray zone (e.g., spray outlets thereof) while restricting or blocking wash fluid from flowing downstream to the other spray zone(s).

As an example, cammed diverter valve 322 may include an active first zone position (e.g., FIG. 7A) directing wash fluid to the first spray zone 312 and restricting wash fluid to the second spray zone 314, third spray zone 316, and fourth spray zone 318. As an additional or alternative example, cammed diverter valve 322 may include an active second zone position (e.g., FIG. 7B) directing wash fluid to the second spray zone 314 and restricting wash fluid to the first spray zone 312, third spray zone 316, and fourth spray zone 318. As another additional or alternative example, cammed diverter valve 322 may include an active third zone position (e.g., FIG. 7C) directing wash fluid to the third spray zone 316 and restricting wash fluid to the first spray zone 312, second spray zone 314, and fourth spray zone 318. As yet another additional or alternative example, cammed diverter valve 322 may include an active fourth zone position (e.g., FIG. 7C) directing wash fluid to the fourth spray zone 318 and restricting wash fluid to the first spray zone 312, second spray zone 314, and third spray zone 316.

In some embodiments, cammed diverter valve 322 includes a radial disk 350 disposed within enclosed cavity 320. Radial disk 350 may extend radially outward from and be rotatable about the central axis A. As shown, radial disk 350 generally provides a solid non-permeable surface (e.g., beneath) outlet plate 324. Nonetheless, radial disk 350 defines one or more disk openings 352 (e.g., along the vertical direction V) to selectively align (e.g., axially align) with the spray outlets 342, 344, 346, 348 (e.g., according to an active position). Optionally, multiple disk openings 352 may be circumferentially or radially spaced apart. In other words, a solid portion of radial disk 350 may separate two or more disk openings 352 along the circumferential direction C or radial direction R.

It is noted that although radial disk 350 is illustrated as a circular plate, another suitable shape (e.g., rectangular plate, fan-blade plate, etc.) may be provided for radial disk 350, as will be understood in light of the present disclosure.

During use, radial disk 350 may be rotatable about the central axis A and relative to the outlet plate 324. In some embodiments, radial disk 350 may engage (e.g., contact) outlet plate 324 (e.g., upper internal surface 330) in an active position. According to the active position, the disk openings 352 may axially align with the spray outlets of the corresponding spray zone; the spray outlets of the other spray zones may be covered by radial disk 350 (e.g., axially aligned with a solid portion of radial disk 350). Wash fluid may thus be permitted to flow through the fluid openings to the axially-aligned spray outlets while advantageously blocking wash fluid to the other spray outlets.

As an example, in the active first zone position, the disk openings 352 may be axially aligned with the first spray outlets 342 to permit wash fluid thereto. The second spray outlets 344, third spray outlets 346, and fourth spray outlets 348 may be covered by the radial disk 350. As an additional or alternative example, in the active second zone position, the disk openings 352 may be axially aligned with the second spray outlets 344; the first spray outlets 342, third spray outlets 346, and fourth spray outlets 348 may be covered by the radial disk 350. As another additional or alternative example, in the active third zone position, the disk openings 352 may be axially aligned with the third spray outlets 346; the first spray outlets 342, second spray outlets 344, and fourth spray outlets 348 may be covered by the radial disk 350. As yet another additional or alternative example, in the active fourth zone position, the disk openings 352 may be axially aligned with the fourth spray outlets 348; the first spray outlets 342, second spray outlets 344, and third spray outlets 346 may be covered by the radial disk 350.

In certain embodiments, cammed diverter valve 322 is slidably, as well as rotatably, mounted within manifold body 310. For instance, cammed diverter valve 322 may be axially slidable along the same central axis A about which cammed diverter valve 322 rotates. In some such embodiments, manifold body 310 includes a support collar 354 that extends along the central axis A within enclosed cavity 320. Optionally, support collar 354 may extend directly from base pan 326 (e.g., at the lower internal surface 332). Support collar 354 may be spaced apart and downstream from fluid inlet 328.

As shown, support collar 354 may define a curved valve path 356 (e.g., as a groove or channel) about the central axis A. Tracing curved valve path 356 along the circumferential direction C, curved valve path 356 may undulate (e.g., axially or up and down). Thus, curved valve path 356 may define discrete peaks and valleys (e.g., vertical maxima and minima) circumferentially spaced apart from each other.

When assembled, cammed diverter valve 322 may be attached to support collar 354. For instance, an axial sleeve 358 of cammed diverter valve 322 may be disposed on support collar 354 radially inward from radial disk 350. A guide cam 360 may extend from axial sleeve 358 (e.g., radially inward) such that guide cam 360 is disposed on or otherwise received within curved valve path 356.

During use, guide cam 360 may be directed along and generally follow curved valve path 356. Axial or vertical movement (e.g., sliding) of cammed diverter valve 322 may thus result in a corresponding rotational movement (e.g., rotating) of cammed diverter valve 322 about the central axis A or support collar 354.

Figure 6A:
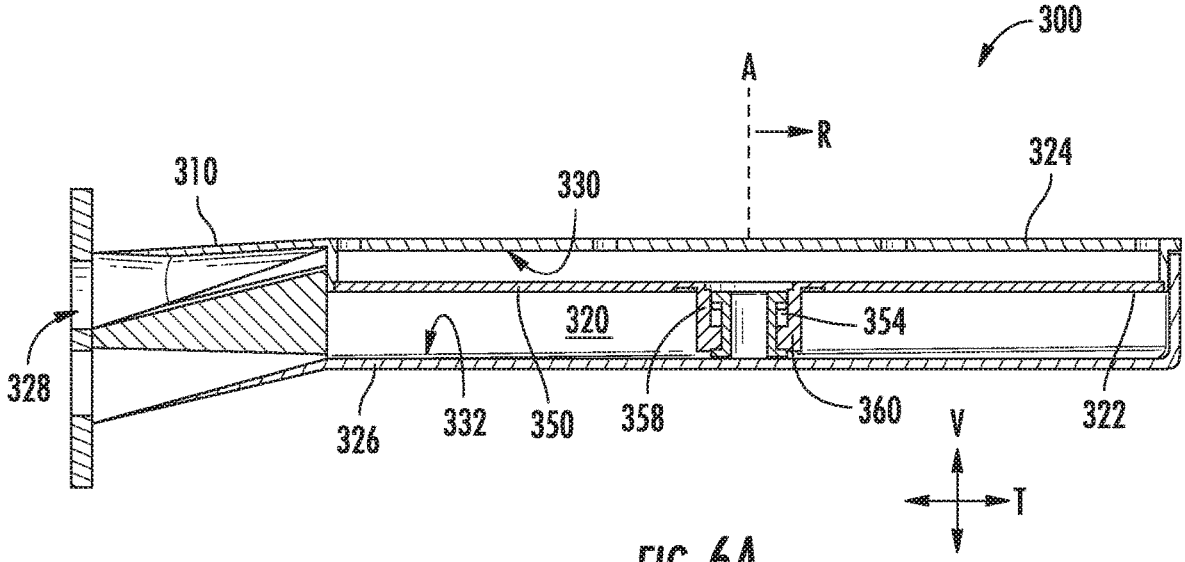
FIG. 6A provides a side, sectional view of the multi-zone spray assembly according to exemplary embodiments of the present disclosure, wherein a diverter valve is in an inactive position.
Figure 6B:
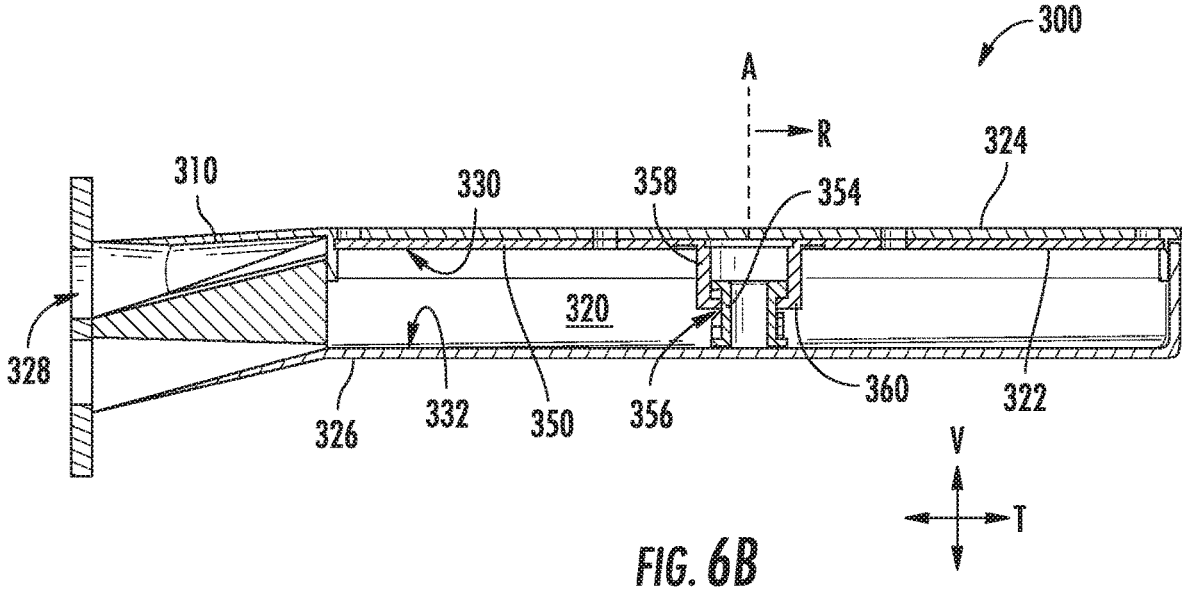
FIG. 6B provides a side, sectional view of the multi-zone spray assembly according to exemplary embodiments of the present disclosure, wherein a diverter valve is in an active position.

In some embodiments, cammed diverter valve 322 is provided with an inactive position (e.g., FIG. 6A). Thus, cammed diverter valve 322 may be movable to the inactive position in addition to the active zone positions. The inactive position may generally correspond to the valleys of curved valve path 356 (e.g., vertical minima) while the active positions correspond to discrete peaks (e.g., such that each active position corresponds to a different vertical maximum). In the inactive position, radial disk 350 may be spaced apart from the outlet plate 324 such that an axial or vertical gap is defined therebetween. For instance, a top surface of radial disk 350 may be separated from the upper internal surface 330 of outlet plate 324. In the inactive position, fluid communication (e.g., of air) between enclosed cavity 320 and each spray outlet 342, 344, 346, 348 may be permitted. By contrast, in the active positions (e.g., FIG. 6B), the radial disk 350 may engage upper internal surface 330.

Due, for example, the undulations of curved valve path 356, moving cammed diverter valve 322 down may sequentially and advantageously shift the active positions. Thus, movement downward from one active position (e.g., active first zone position) to the inactive position may cause radial disk 350 to rotate such that the following movement upward from the inactive position is to the following or sequentially-adjacent active position (e.g., active second zone position). In the illustrated embodiments, axial movement of cammed diverter valve 322 follows the sequential pattern of inactive position-first active zone position-inactive position-second active zone position-inactive position-third active zone position-inactive position-fourth active zone position. Following the fourth active zone position, the pattern repeats.

In certain embodiments, axial movement of cammed diverter valve 322 is driven by the flow of wash fluid. Thus, cammed diverter valve 322 may be hydraulically urged along the central axis A. Specifically, pressure generated by the flow of wash fluid against radial disk 350 may force cammed diverter valve 322 (e.g., upward or downstream) from the inactive position to an active position. The absence of wash fluid within the enclosed cavity 320 or otherwise halting the flow of wash fluid may permit cammed diverter valve 322 to return to the inactive position (e.g., as motivated by a gravity or a spring mounted between cammed diverter valve 322 and manifold body 310 to bias cammed diverter valve 322 to the inactive position). In some such embodiments, pulsing the flow wash fluid may thus advantageously shift cammed diverter valve 322 and selectively alternate the coverage of wash fluid spray from manifold body 310. Optionally, controller 160 (FIG. 2) may be configured to pulsate a pump (e.g., circulation pump 152—FIG. 2) during a wash or rinse cycle. For instance, during a wash or rinse cycle, the rotation of the pump may be temporarily halted for a brief period (e.g., less than five seconds) before the pump is reactivated to rotate and resume the flow of wash fluid to manifold body 310.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a tub defining a wash chamber;

a pump configured to deliver a wash fluid into the wash chamber;

a rack assembly comprising a slidable rack slidably disposed within the wash chamber; and a spray assembly housed within the wash chamber of the tub in fluid communication with the pump to receive the wash fluid therefrom, the spray assembly comprising a manifold body mountable within the wash chamber of the dishwashing appliance, the manifold body defining a fluid inlet to receive a wash fluid within the manifold body, a first spray zone downstream from the fluid inlet, the first spray zone comprising a first spray outlet disposed below and directed at the slidable rack above the manifold body, and a second spray zone downstream from the fluid inlet, the second spray zone comprising a second spray outlet spaced apart from the first spray outlet, the second spray outlet being disposed below and directed at the slidable rack; and a cammed diverter valve mounted within the manifold body within the wash chamber upstream from the first and second spray zones, the cammed diverter valve being hydraulically actuated and movable between a first zone position and a second zone position, the first zone position directing at least a portion of the wash fluid to the first spray zone and restricting the wash fluid to the second spray zone, and the second zone position directing at least a portion of the wash fluid to the second spray zone and restricting the wash fluid to the first spray zone, wherein the slidable rack is attached to the manifold body downstream from the first and second spray zones, the manifold body being slidable with the slidable rack to move relative to the wash chamber, and wherein the manifold body comprises an outlet plate attached to a base pan, the outlet plate defining the first and second spray outlets therethrough, the outlet plate and the base pan defining an enclosed cavity therebetween, the cammed diverter valve being mounted within the enclosed cavity downstream from the fluid inlet.

2. The dishwashing appliance of claim 1, wherein the manifold body further comprises a support collar extending along a central axis within the enclosed cavity, wherein the support collar defines a curved valve path about the central axis, and wherein the cammed diverter valve comprises a guide cam disposed on the curved valve path, the guide cam being slidably and rotatably mounted on the support collar.

3. The dishwashing appliance of claim 2, wherein the cammed diverter valve comprises a radial disk disposed within the enclosed cavity, wherein the radial disk is hydraulically urged along the central axis and toward the outlet plate in the first and second zone positions.

4. The dishwashing appliance of claim 3, wherein the cammed diverter valve is further movable to an inactive position in which the radial disk is spaced apart from the outlet plate.

5. The dishwashing appliance of claim 3, wherein the radial disk defines a disk opening, the disk opening being axially aligned with the first spray outlet in the first zone position and axially aligned with the second spray outlet in the second zone position.

6. The dishwashing appliance of claim 1, wherein the first spray outlet is one spray outlet of a plurality of first spray outlets defined through the outlet plate as part of the first spray zone, and wherein the plurality of first spray outlets are circumferentially spaced apart about the central axis.

7. The dishwashing appliance of claim 6, wherein the second spray outlet is one spray outlet of a plurality of second spray outlets defined through the outlet plate as part of the second spray zone, wherein the plurality of second spray outlets are circumferentially spaced apart about the central axis, and wherein the second spray zone overlaps with the first spray zone.

8. A dishwashing appliance, the dishwashing appliance comprising:

a tub defining a wash chamber;

a pump configured to deliver a wash fluid into the wash chamber;

a rack assembly comprising a slidable rack slidably disposed within the wash chamber; and a spray assembly housed within the wash chamber of the tub in fluid communication with the pump to receive the wash fluid therefrom, the spray assembly comprising a manifold body disposed below the slidable rack, the manifold body defining a fluid inlet to receive the wash fluid within the manifold body, a first spray zone downstream from the fluid inlet, the first spray zone comprising a first spray outlet disposed below and directed at the slidable rack, and a second spray zone downstream from the fluid inlet, the second spray zone comprising a second spray outlet directed to the wash chamber and spaced apart from the first spray outlet, the second spray outlet being disposed below and directed at the slidable rack; and a cammed diverter valve mounted within the manifold body upstream from the first and second spray zones, the cammed diverter valve being movable between a first zone position and a second zone position, the first zone position directing at least a portion of the wash fluid to the first spray zone and restricting the wash fluid to the second spray zone, and the second zone position at least a portion of the directing wash fluid to the second spray zone and restricting the wash fluid to the first spray zone.

9. The dishwashing appliance of claim 8, wherein the slidable rack is attached to the manifold body downstream from the first and second spray zones, the manifold body being slidable with the slidable rack to move relative to the wash chamber.

10. The dishwashing appliance of claim 8, wherein the manifold body comprises an outlet plate attached to a base pan, the outlet plate defining the first and second spray outlets therethrough, the outlet plate and the base pan defining an enclosed cavity therebetween, the cammed diverter valve being mounted within the enclosed cavity downstream from the fluid inlet.

11. The dishwashing appliance of claim 10, wherein the manifold body further comprises a support collar extending along a central axis within the enclosed cavity, wherein the support collar defines a curved valve path about the central axis, and wherein the cammed diverter valve comprises a guide cam disposed on the curved valve path, the guide cam being slidably and rotatably mounted on the support collar.

12. The dishwashing appliance of claim 11, wherein the cammed diverter valve comprises a radial disk disposed within the enclosed cavity, wherein the radial disk is hydraulically urged along the central axis and toward the outlet plate in the first and second zone positions.

13. The dishwashing appliance of claim 12, wherein the cammed diverter valve is further movable to an inactive position in which the radial disk is spaced apart from the outlet plate.

14. The dishwashing appliance of claim 12, wherein the radial disk defines a disk opening, the disk opening being axially aligned with the first spray outlet in the first zone position and axially aligned with the second spray outlet in the second zone position.

15. The dishwashing appliance of claim 10, wherein the first spray outlet is one spray outlet of a plurality of first spray outlets defined through the outlet plate as part of the first spray zone, and wherein the plurality of first spray outlets are circumferentially spaced apart about the central axis.

16. The dishwashing appliance of claim 15, wherein the second spray outlet is one spray outlet of a plurality of second spray outlets defined through the outlet plate as part of the second spray zone, wherein the plurality of second spray outlets are circumferentially spaced apart about the central axis, and wherein the second spray zone overlaps with the first spray zone.

17. A dishwashing appliance, the dishwashing appliance comprising:

a tub defining a wash chamber;

a pump configured to deliver a wash fluid into the wash chamber;

a rack assembly comprising a slidable rack slidably disposed within the wash chamber, the slidable rack defining a rack chamber;

a diverter mounted below the rack chamber downstream from the pump; and a spray assembly housed within the wash chamber of the tub in fluid communication with the pump and downstream from the diverter to receive the wash fluid therefrom, the spray assembly comprising a manifold body disposed below the slidable rack, the manifold body defining a fluid inlet to receive the wash fluid within the manifold body, a first spray zone downstream from the fluid inlet, the first spray zone comprising a first spray outlet disposed below and directed at the slidable rack, and a second spray zone downstream from the fluid inlet, the second spray zone comprising a second spray outlet directed to the wash chamber and spaced apart from the first spray outlet, the second spray outlet being disposed below and directed at the slidable rack; and a cammed diverter valve mounted within the wash chamber within the manifold body upstream from the first and second spray zones, the cammed diverter valve being movable between a first zone position and a second zone position, the first zone position directing at least a portion of the wash fluid to the first spray zone and restricting the wash fluid to the second spray zone, and the second zone position at least a portion of the directing wash fluid to the second spray zone and restricting the wash fluid to the first spray zone, wherein the manifold body further comprises a support collar extending along a central axis within the enclosed cavity, wherein the support collar defines a curved valve path about the central axis, wherein the cammed diverter valve comprises a guide cam disposed on the curved valve path, the guide cam being slidably and rotatably mounted on the support collar, wherein the cammed diverter valve comprises a radial disk disposed within the enclosed cavity, and wherein the radial disk is hydraulically urged upward along the central axis and toward the outlet plate in the first and second zone positions.

18. The dishwashing appliance of claim 17, wherein the slidable rack is attached to the manifold body downstream from the first and second spray zones, the manifold body being slidable with the slidable rack to move relative to the wash chamber.

* * * * *